United States Patent [19]

Lin

[11] Patent Number: 4,979,219

[45] Date of Patent: Dec. 18, 1990

[54] PIEZOELECTRIC SPEAKERS

[76] Inventor: Kuang-Yao Lin, No. 5, Lane 110, Wei-Kuao Street, Tainan, Taiwan

[21] Appl. No.: 322,978

[22] Filed: Mar. 14, 1989

[51] Int. Cl.[5] ..... H04R 25/00

[52] U.S. Cl. ..... 381/190; 381/156; 310/324

[58] Field of Search ..... 381/190, 191, 159, 156, 381/203; 310/324; 340/388

[56] References Cited

FOREIGN PATENT DOCUMENTS 0085194 8/1983 European Pat. Off. ..... 381/190

*Primary Examiner*—Jin F. Ng

*Assistant Examiner*—M. Nelson McGeary III

[57] ABSTRACT

A piezoelectric speaker comprises a drive unit having an auxiliary diaphragm bonded with a piezoelectric transducer element for producing sound thereby and a horn member having a resonance device including a reflection cover defining a plurality of first cusps and a mid plate defining a plurality of second cusps laterally offset with respect of the plurality of first cusps for promoting the sound output in decibel of the speaker.

4 Claims, 2 Drawing Sheets

PIEZOELECTRIC SPEAKERS

BACKGROUND OF THE INVENTION

1. Field of the Invention

This invention relates to the design and construction of a piezoelectric speaker, particularly to the design and construction of a piezoelectric speaker with its piezoelectric transducer unit having an auxiliary diphragm for producing smooth sound and the horn member having a resonance device for increasing volume of sound output.

2. Prior art

A piezoelectric speaker is driven by a piezoelectric transducer which has an element being powered by a small disc of special piezo materials such as crystals, ceramics, towrmaline, Rochelle salt and so on, that changes its diameter when an electrical signal is applied across its surfaces. To convert this change in diameter to a sound output, the disc is bonded to a thin metal disc which acts as a restraining spring force on one surface of the former disc. An electrical signal of increasing amplitude causes the diameter of the former disc to change which causes the element to bend from a flat shape into a convex shape. When the polarity of the electrical signal reverses, the element will bend in the reverse direction into concave shape. If the applied electrical signal has a frequency of 2K Hz, then the metal disc will vibrate and produce sound at a frequency of 2K Hz.

A known piezoelectric speaker, as shown in FIG. 1, mainly comprises a tubular outer shell 10 provided with a tapered peripheral upper edge, a first cover 11 functioning as a horn and having a base 111 and an integrally formed circular side wall 112 provided with a peripheral edge which is divided into an inner flat edge 110 extending inwardly and an outer tapered edge engaged with the tapered upper edge of the shell 10. The first cover 11 is further provided with a plurality of air ports 12 in the angle portion and a hole 13 in the central portion of the base 111. A piezoelectric transducer element 20 comprises a copper disc 210 with an outer periphery corresponding to the inner side wall of the tubular shell 10 and a ceramic disc 211 of smaller diameter bonded to a central bottom side wall of the copper disc 210. A second cover 22 having a base and an integrally formed circular side wall is upwardly inserted into the cylindrical space of the shell 10 by means of a press fit so as to retain the transducer element 20 in a position between the first and the second covers 11, 22 by means of a peripheral edge thereof coacting with the flat edge 110 of the first cover 11.

The known piezoelectric speaker so constructed is found disadvantageous that, referring to FIG. 5, the output sound waves are tipped in a frequency range from 1.5K Hz to 4.0K Hz as said output sound waves are directly produced by vibration of the copper disc 210. The sound output is low in decibel as the sound waves lack the effect of resonance.

Another known piezoelectric speaker, as shown in FIG. 2, mainly comprises a pot-shaped shell 30 defining a chamber 301 having a stepped wall which provides a diaphragm seat 302 and a diaphragm 31 functioning as a supporter which includes a tapering outwardly extending circular side portion 311 having a first circular flat rim 312 angled inwardly and a circular crimped area 313 which terminates in a second flat rim 314 rested on and further secured to the diaphragm seat 302 with a ring 310 fastened to the diaphragm seat 302 by means of a press fit. A piezoelectric transducer element 32 comprises a copper disc 320 with a peripheral edge fastened to the first flat rim 312 by means of a heat seal or an adhesive and thus supported, and a ceramic disc 211 of smaller diameter bonded to a central portion of a bottom side wall of the copper disc.

It is found disadvantageous that the acoustic property and the volume in decibel are unsatisfactory as the sound waves are still directly produced by vibration of the copper disc and lack the effect of resonance.

SUMMARY OF THE INVENTION

It is therefore a primary object of this invention to provide an improved piezoelectric speaker that overcomes the foregoing disadvantages associated with the prior art.

The piezoelectric speaker according to the present invention comprises: a frame including a circular side wall having a sloped upper inner side wall and a mid plate defining a first chamber therebelow and a second chamber thereabove in the circular side wall, the mid plate defining a throttle hole therethrough interconnecting the chambers; a diaphragm inserted in the first chamber; a cover press-fitted in the first chamber with a circular side wall thereof retaining the diaphragm in position by means of a peripheral top edge of the circular side wall coacting with the circular rim of the first chamber; a piezoelectric transducer element longitudinally bonded underneath to the diaphragm; and a reflection conver extending over, but spaced from the mid plate, having a curving cross-sectional configuration with a protruding tip located adjacent to the central hole of the mid plate and defining a plurality of discharge openings uniformly located around an outer periphery.

DETAILED DESCRIPTION OF THE PREFERRED EMBODIMENT

Figure 1:
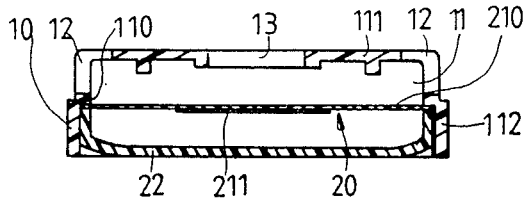
FIG.1 (PRIOR ART)
FIG. 1 is a cross-sectional view of a known piezoelectric speaker.
Figure 2:
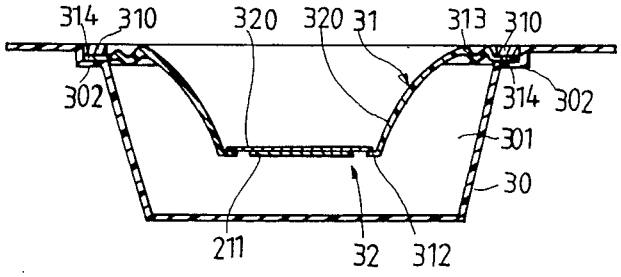
FIG.2 (PRIOR ART)
FIG. 2 is a cross-sectional view of another known piezoelectric speaker.
Figure 3:
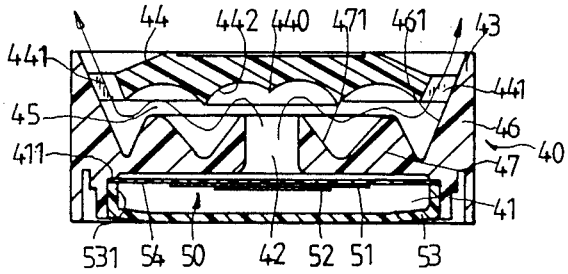
FIG. 3 is a cross-sectional view of a piezoelectric speaker embodying the present invention.

Referring to FIG. 3, the preferred embodiment of the present invention comprises a circular frame 40 defining a first (lower) chamber 41, a second (upper) chamber 45 and a throttle hole 42 functioning as a throttle and interconnecting the chambers 41, 45; a piezoelectric transducer element 50 bonded to a diaphragm 54 which is inserted in the first chamber 41; a cover 53 fastened in the first chamber 41 to retain the diaphragm 54 in position; and a reflection cover 44 functioning as a horn and secured to the circular frame 40 in the second chamber 45.

The circular frame 40 includes a circular side wall 46 having a sloped inner side wall 461, and a mid plate 47 having a wavy upper surface terminating at the lower end of the sloped side wall 461 and defining the throttle hole 42 axially through its central portion, which interconnects the first and second chambers 41, 45 defined by the circular side wall 46 and mid plate 47.

The first chamber 41 has a stepped wall which provides a peripheral flat rim 411. The piezoelectric transducer element 50 includes a copper disc 51 of smaller diameter than the diaphragm 54 and a ceramic disc 52 of even smaller diameter. These elements are sequentially bonded underneath to the diaphragm 54 which is retained in position by means of the flat rim 411 coacting with a peripheral top edge of a circular side wall 531 of the cover 53 which is fastened in the frame 40 by means of a press fit.

The reflection cover 44, with a tip 440 on its inner surface pointing inwardly towards the central portion of the throttle hole 42, is mounted on the sloped inner side wall 461 of the frame 40 and defines a plurality of discharge openings 441 uniformly located around the outer periphery. The reflection cover 44 futher has a wavy inner surface of which the contours 442 are staggered with respect to the contours 471 of the opposing surface of the mid plate 47.

The sound waves formed by the vibrating air in the air chamber 45 driven by the diaphragm 54 radiate through the throttle hole 42, are reflected by the reflection cover 44, distributed radially along the wavy passages in second chamber 45 and are eventually discharged through the openings 441.

It should be noted that the axial distance between the diaphragm 54 and the inlet of the throttle hole 42 is preferably 0.6 +0.1 mm.

Figure 4:
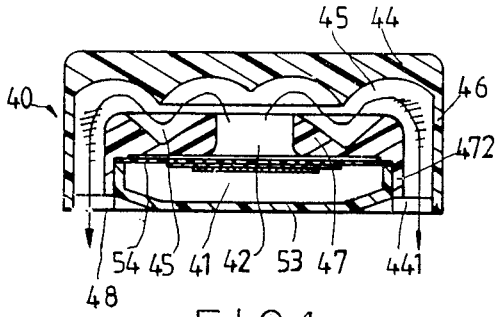
FIG. 4 is a cross-sectional view of another embodiment of a piezoelectric speaker embodying the present invention.

Alternatively, illustrated in FIG. 4, the reflection cover 44 and the circular side wall 46 of the frame 40 can be formed integrally to engage the corresponding periphery of a flange 48 attached underneath to the mid plate 47 through a connector 472, extending outwardly and defining a plurality of discharge openings 441 uniformly located around its outer periphery. The sound waves formed by the vibrating air in the air chamber 45 driven by diaphragm 54 through the throttle hole 42, are reflected by the reflection cover 44, continue to radiate along the wavy passage in second chamber 45 radially and downwardly, and are eventually discharged through the discharge openings 441.

Figure 5:
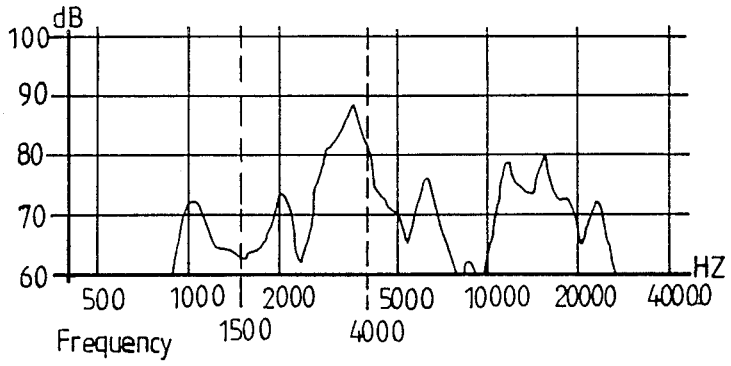
FIG.5 (PRIOR ART)
FIG. 5 is a chart of output sound waves of the known piezoelectric speaker shown in FIG. 1.
Figure 6:
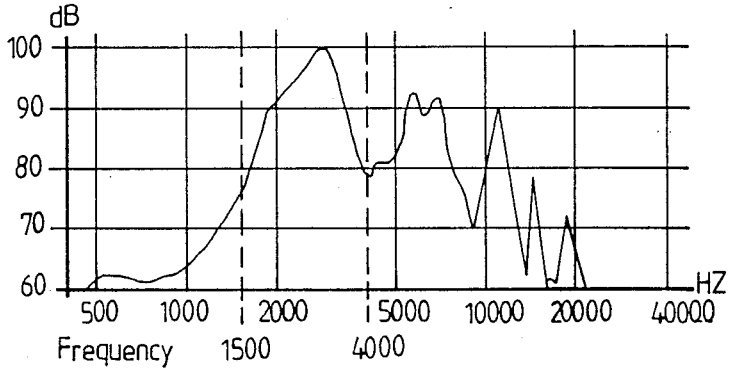
FIG. 6 is a chart of output sound waves of the piezoelectric speaker of the present invention.

Referring to FIG. 6 in comparison with FIG. 5, as the sound waves formed by the vibrating air are driven by diaphram 54 which is actuated by the bonded piezoelectric transducer element 50 according to the present invention, the sound waves are much more smooth than that of the known speakers within the frequency range from 1.58K Hz to 4.0K Hz. In addition, radiation along the wavy passages in the second chamber 45 enhances the resonance effect of the sound waves, thus the volume in decibels of the speakers is promoted and the acoustic property is also improved.

It will be appreciated, of course, that although some particular embodiments of the present invention have been shown and described, modifications may be made. It is intended in the following claims to cover all modifications which fall within the scope of the invention.

What is claimed is:

1. A piezoelectric speaker comprising:

a frame including a generally circular side wall portion having a sloped inner side wall; a mid plate defining with the frame a first chamber therebelow having a circular rim and a second chamber thereabove with the circular side wall, the mid plate also defining a throttle hole therethrough interconnecting the first and second chambers;

a diaphragm inserted in the first chamber;

a cover means press-fitted to the frame in the first chamber and having a circular side wall thereof retaining the diaphragm in position by means of a peripheral top edge of the circular side wall coacting with the circular rim of the mid plate;

a piezoelectric transducer element longitudinally bonded underneath to the diaphragm; and, a reflection cover extending over the second chamber and, spaced from the mid plate, the reflection cover having a contoured inner surface with a curved cross-sectional configuration with a protruding tip located adjacent to the throttle hole of the mid plate and defining a plurality of discharge openings uniformly located around an outer periphery.

2. A piezoelectric speaker as claimed in claim 1 wherein the diaphragm is axially spaced from an inlet of the throttle hole of the mid plate a distance of from 0.5 mm to 0.7 mm.

3. A piezoelectric speaker as claimed in claim 1 wherein the inner surface of the reflection cover defines a plurality of first cusps and an adjacent surface of the mid plate defines a plurality of second cusps laterally offset with respect to the plurality of first cusps.

4. A piezoelectric speaker comprising:

a frame including a mid plate having a throttle hole, a circular side wall extending downwardly from a peripheral edge of the mid plate and a flange, the frame defining a first chamber communicating with the throttle hole and the flange defining a plurality of uniformly disposed discharge openings;

a diaphragm inserted in the first chamber;

a cover means press-fitted to the frame in the first chamber with a circular side wall thereof retaining the diaphragm in position by means of a peripheral top edge of the circular side wall coacting with a portion of the mid plate;

a piezoelectric transducer element longitudinally bonded underneath to the diaphragm; and, a reflection cover having a top wall extending over, but spaced from the mid plate, defining a second chamber, the top wall having a contoured inner surface with a curved cross-sectional configuration with a protruding tip located adjacent to the throttle hole of the mid plate and a circular side wall extending downwardly from a peripheral edge of the top wall so as to engage a periphery of the flange.

* * * * *